US006392212B1

(12) United States Patent
Han et al.

(10) Patent No.: US 6,392,212 B1
(45) Date of Patent: May 21, 2002

(54) MICROWAVE OVEN

(75) Inventors: Yong-woon Han, Kunpo; Seong-deog Jang; Kwang-seok Kang, both of Suwon; Han-jun Sung, Seoul, all of (KR)

(73) Assignee: SamSung Electronics, Co., Ltd., Suwon (KR)

( * ) Notice: Subject to any disclaimer, the term of this patent is extended or adjusted under 35 U.S.C. 154(b) by 13 days.

(21) Appl. No.: 09/645,551

(22) Filed: Aug. 25, 2000

(30) Foreign Application Priority Data

Sep. 22, 1999 (KR) ..... 99-41030

(51) Int. Cl.[7] ..... H05B 6/78

(52) U.S. Cl. ..... 219/762; 219/754; 219/732; 219/756; 126/338; 99/DIG. 14

(58) Field of Search ..... 219/725, 732, 219/733, 734, 756, 752, 753, 754, 762, 763, 392; 312/236; 126/337 A, 337 R, 338, 339, 340; 99/DIG. 14

(56) References Cited

U.S. PATENT DOCUMENTS

| | | | | | |
|---|---|---|---|---|---|
| 2,542,162 | A | * | 2/1951 | Sutton | 312/236 |
| 4,481,395 | A | * | 11/1984 | Smith et al. | 219/756 |
| 4,693,867 | A | * | 9/1987 | Commarmot et al. | 219/756 |
| 4,748,308 | A | * | 5/1988 | Drews | 219/763 |
| 4,751,357 | A | * | 6/1988 | Boulard | 219/762 |
| 4,855,555 | A | | 8/1989 | Adams et al. | |
| 5,288,962 | A | | 2/1994 | Lorence et al. | |
| 5,690,852 | A | * | 11/1997 | Saito et al. | 219/725 |
| 5,893,997 | A | | 4/1999 | Gustafsson | |
| 5,908,576 | A | * | 6/1999 | Henning | 219/753 |
| 5,935,480 | A | | 8/1999 | Takeoka et al. | |
| 6,013,910 | A | | 1/2000 | Ferraro et al. | |

FOREIGN PATENT DOCUMENTS

| | | | | |
|---|---|---|---|---|
| DE | 41 01 112 A1 | | 7/1992 | |
| EP | 0 358 561 | * | 3/1990 | 219/754 |
| GB | 1447782 A | | 9/1976 | |
| JP | 62-299619 | * | 12/1987 | 219/762 |

OTHER PUBLICATIONS

Office Action (Issue date: Oct. 2, 2001) issued by German Patent Office regarding German Patent Application No. 10038115.4–34 filed on Aug. 4, 2000.

"Combined Search and Examination Report Under Sections 17 and 18(3)", British Patent Office, Feb. 26, 2001.

* cited by examiner

*Primary Examiner*—Philip H. Leung
(74) *Attorney, Agent, or Firm*—Robert E. Bushnell, Esq.

(57) ABSTRACT

A microwave oven is conveniently used even when a vibration and/or shock are applied to a vessel containing food by preventing the vessel from falling down. The microwave oven includes a cabinet having a cooking chamber and a driving chamber, a high frequency generating section for generating high frequency waves and supplying the high frequency waves to the cooking chamber, and a vessel supporting section for supporting a vessel containing food in the cooking chamber so as to prevent the vessel from falling due to a vibration and/or shock. The vessel supporting section includes a supporting member selectively installed to be contacted with a certain inner wall of the cooking chamber, and at least a supporting ring installed at a side of the supporting member for receiving and supporting the vessel. Here, the supporting ring is separated into two members, while the two members are elastically biased in a direction wherein the leading ends of the two members face each other and are pivotally installed at the inner wall of the cooking chamber by a hinge pin.

17 Claims, 5 Drawing Sheets

MICROWAVE OVEN

CLAIM OF PRIORITY

This application makes reference to, incorporates the same herein, and claims all benefits accruing under 35 U.S.C. §119 from the inventor's application MICROWAVE OVEN filed with the Korean Industrial Property Office on Sep. 22, 1999 and there duly assigned Ser. No. 410301/1999.

BACKGROUND OF THE INVENTION

1. Field of the Invention

The present invention relates to a microwave oven, and more particularly to a microwave oven to be conveniently used by preventing the failing of a vessel containing food to be cooked even when the microwave oven is used in a vehicle in motion.

2. Description of the Related Art

Generally, a microwave oven is used in the kitchen where an alternating current power source is provided. Recently, new microwave ovens, which can be operated by both a direct current power source and an alternating power source, have been developed so that the microwave oven can be easily utilized outside of the kitchen as well as in.

A conventional microwave oven includes a cabinet which is divided into a cooking chamber and a driving chamber. Food to be cooked is placed in the cooking chamber. A circular guide groove is formed on the bottom of the driving chamber, while rollers of a rotating guide are positioned in the guide groove. A tray where a vessel containing food to be cooked is placed is loaded on the rollers of the rotation guide. The tray is detachably coupled with a driving shaft of a motor 8 so as to be rotated by the motor.

Meanwhile, the driving chamber of the cabinet is provided with several parts for supplying high frequency waves to the cooking chamber, such as a magnetron for generating the high frequency waves, and a wave guide for guiding the generated high frequency waves from the magnetron.

According to the conventional microwave oven as constructed above, the high frequency waves generated from the magnetron are supplied to the cooking chamber through the wave guide so that the food contained in the vessel is cooked. During the operation, the tray is rotationally supported by the rollers of the rotation guide and rotated by the motor so that the high frequency waves are evenly spread on the food.

However, the conventional microwave oven has drawbacks, that is, since there is no means for supporting the vessel containing the food in the cooking chamber, the vessel containing the food falls down and the food spills inside of the cooking chamber due to the vibration and shocks generated during the driving of the vehicle when the conventional microwave oven is loaded in the vehicle to be operated.

SUMMARY OF THE INVENTION

It is therefore an object of the present invention to provide an improved microwave oven.

A further object of the invention is to provide a microwave oven which can be used in a vehicle in motion.

A yet further object of the invention is to provide a microwave oven which is less susceptible to spillage of food or cooking vessels due to shock or vibration.

The above objects are accomplished by a microwave oven according to the present invention, which includes: a cabinet having a cooking chamber and a driving chamber; a high frequency generating section for generating high frequency waves and supplying the high frequency waves to the cooking chamber; and a vessel supporting section for supporting a vessel containing food in the cooking chamber so as to prevent the vessel from falling due to a vibration and/or shocks.

Here, the vessel supporting section includes at least a supporting ring for receiving and supporting the vessel in the cooking chamber, while the supporting ring may be directly installed one of inner walls of the cooking chamber or installed to a supporting member which is selectively provided in the cooking chamber.

According to the preferred embodiment, the supporting ring is separated into two members, while the two members are elastically biased in a direction wherein the leading ends of the two members face each other and are pivotally installed at the inner wall of the cooking chamber by a hinge pin.

According to the preferred embodiment, the microwave oven further includes a tray being provided in the cooking chamber and the vessel is placed thereon; and a tray driving section installed in the driving chamber for rotatably driving the tray.

According to the microwave oven of the present invention, since the cooking operation is performed in a state that the vessel containing food is fixed to be prevented from swaying by the vessel supporting section, the vessel containing food does not fall down even when the vibration and/or the external shocks are applied to the vessel. Accordingly, the cooking operation may be conveniently performed even when the microwave oven is used in a vehicle in motion.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
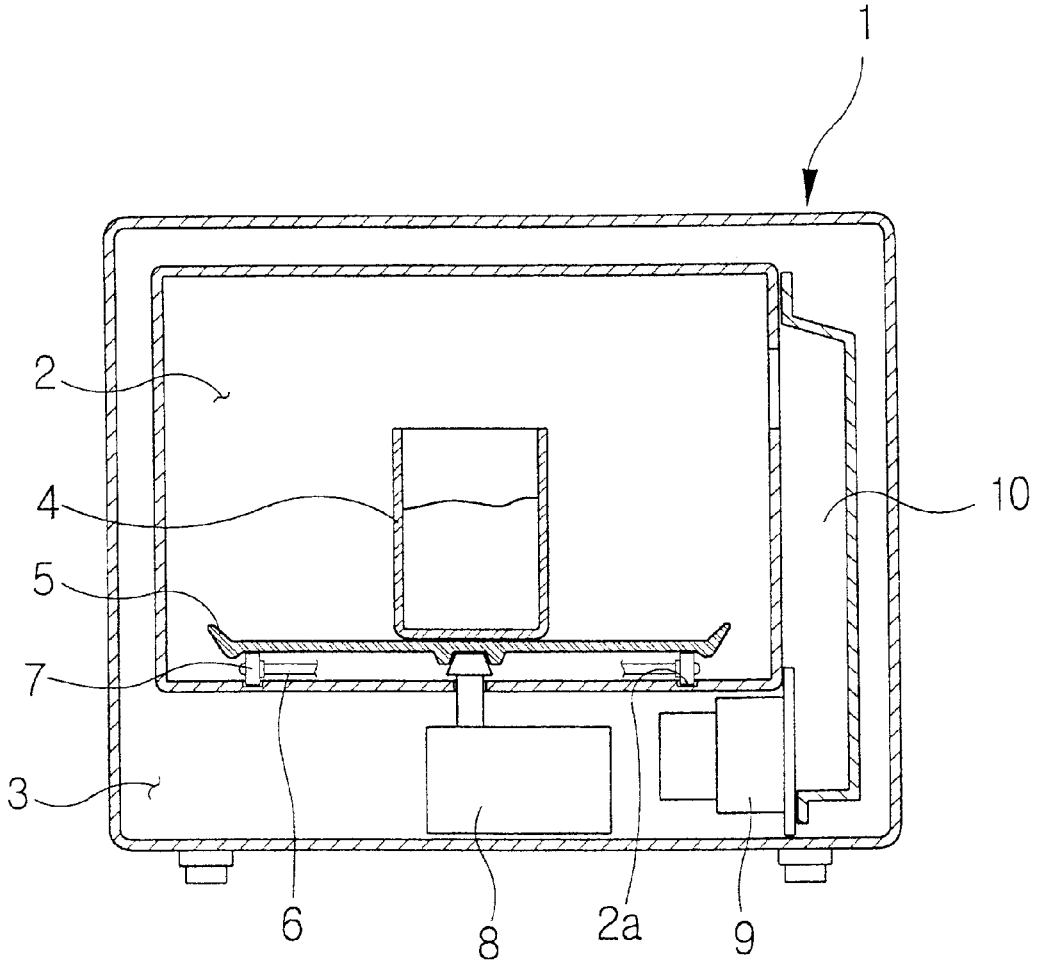
FIG. 1 (PRIOR ART)
FIG. 1 is a sectional view showing a conventional microwave oven.

The conventional microwave oven described above will now be described with reference to the drawings. As shown in FIG. 1, the conventional microwave oven includes a cabinet 1 which is divided into a cooking chamber 2 and a driving chamber 3. Food to be cooked is placed in the cooking chamber 2.

Figure 2:
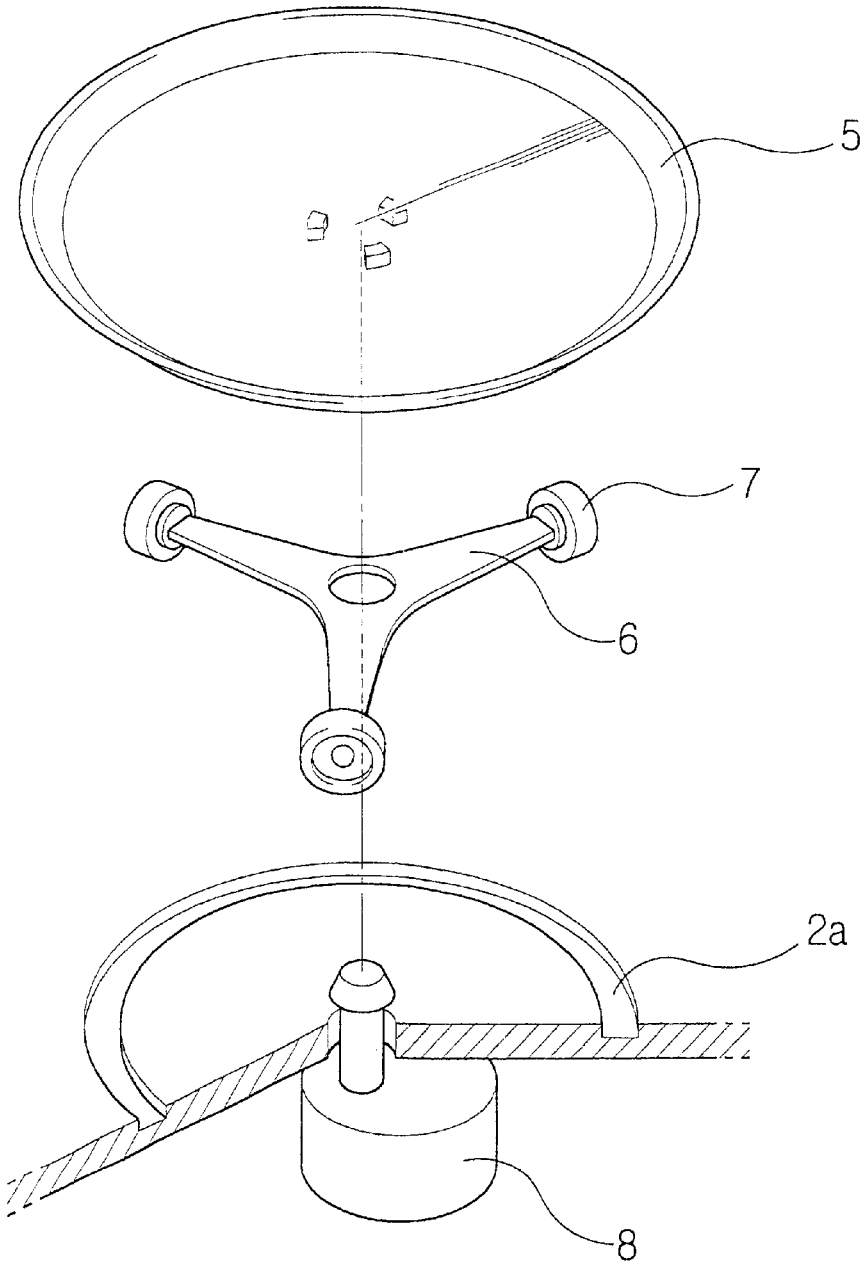
FIG.2 (PRIOR ART)
FIG. 2 is an exploded perspective view showing the main parts of the conventional microwave oven in FIG. 1.

As shown in FIG. 2, a circular guide groove 2*a* is formed on the bottom of the driving chamber 2, while rollers 7 of a rotating guide 6 are positioned in the guide groove 2*a*. A tray 5 where a vessel 4 containing food to be cooked is placed is loaded on the rollers 7 of the rotation guide 6. The tray 5 is detachably coupled with a driving shaft of a motor 8 so as to be rotated by the motor 8.

Meanwhile, the driving chamber 3 of the cabinet 1 is provided with several parts for supplying high frequency waves to the cooking chamber 2, such as a magnetron 9 for generating the high frequency waves, and a wave guide 10 for guiding the generated high frequency waves from the magnetron 9.

According to the conventional microwave oven as constructed above, the high frequency waves generated from the magnetron 9 are supplied to the cooking chamber 2 through the wave guide 10 so that the food contained in the vessel 4 is cooked. During the operation, the tray 5 is rotationally supported by the rollers 7 of the rotation guide 6 and rotated by the motor 8 so that the high frequency waves are evenly spread on the food.

Figure 3:
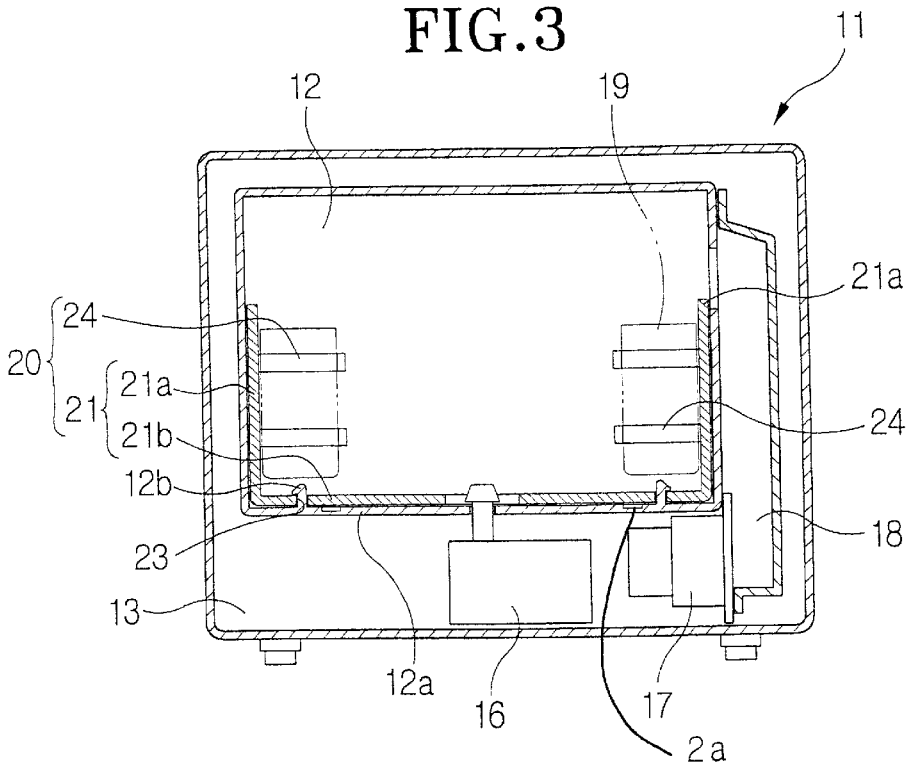
FIG. 3 is a plan view showing a microwave oven according to a preferred embodiment of the present invention.
Figure 4:
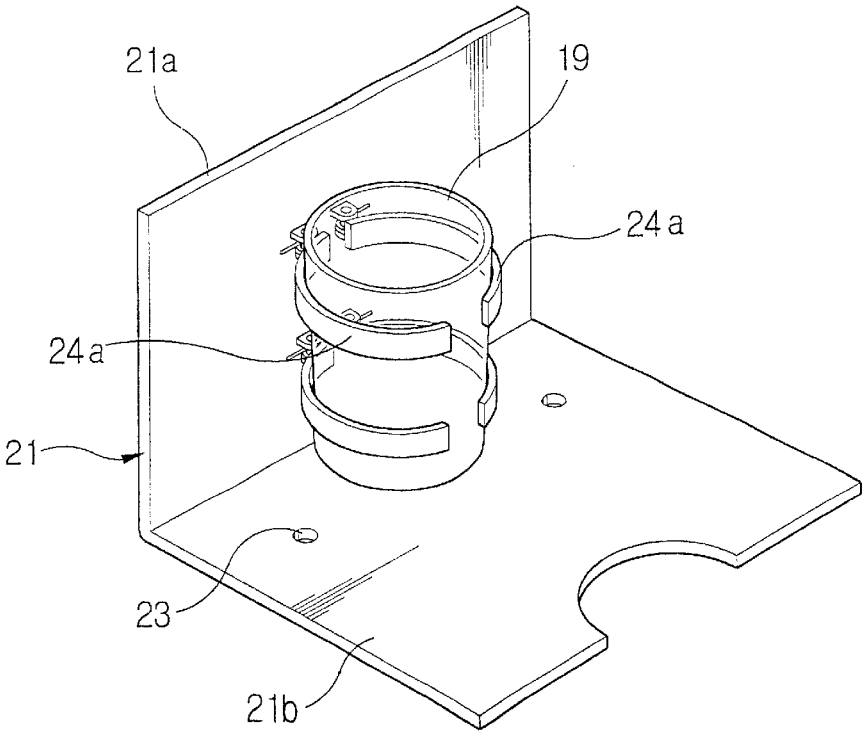
FIG. 4 is a perspective view showing a vessel supporting means as a main part of the microwave oven in FIG. 3.
Figure 5:
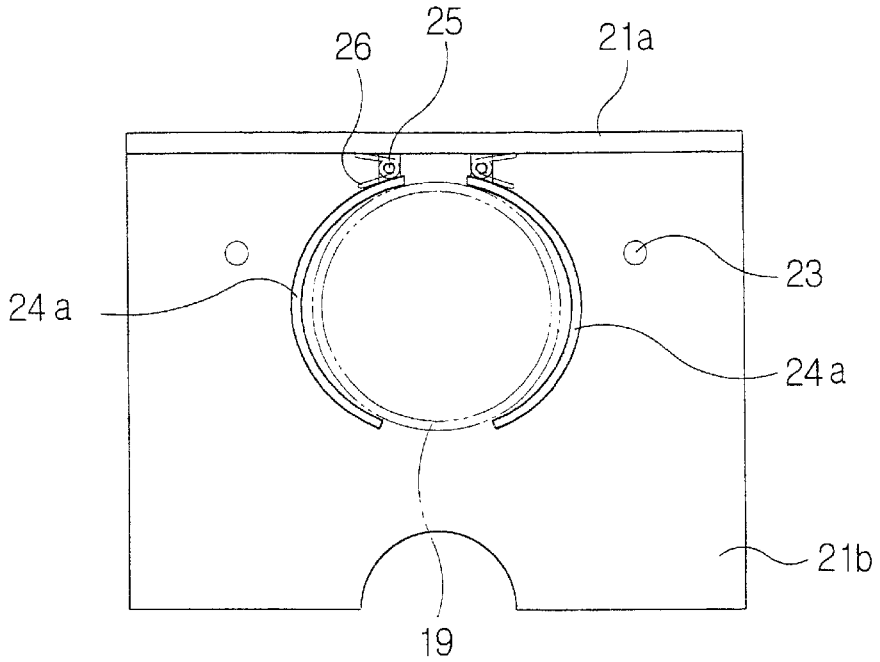
FIG. 5 is a plan view of FIG. 4.

The present invention will now be described with reference to the drawings. FIGS. 3 through 5 show a microwave oven according to a preferred embodiment of the present invention. As shown in FIG. 3, a microwave oven according to a preferred embodiment of the present invention includes a cabinet 11 having a cooking chamber 12 where food is placed and cooked, a driving chamber 13, and a vessel supporting section 20 for supporting a vessel 19 for containing food in the cooking chamber 12 to prevent the falling down of the vessel 19 due to vibration and/or shock. The vessel supporting section 20 represents part of a restraining means restraining the vessel to prevent the vessel from tipping.

The microwave oven according to the preferred embodiment of the present invention, further includes a tray 5 where a vessel 19 containing the food may be loaded, and a rotation guide 6 whose rollers 7 rotatably support the tray 5. Tray 5 and rotation guide 6 are removable and are not shown in FIG. 3, but may be structured as in FIG. 1. The tray is rotated by a motor 16 which is installed in the driving chamber 13. In the driving chamber 13, the motor for rotatably driving the tray 5, a magnetron 17 for generating high frequency wave, and a wave guide 18 for supplying the high frequency wave from the magnetron 17 to the cooking chamber 12, are installed.

Meanwhile, the microwave oven constructed as above includes a supporting member 21 selectively inserted into the cooking chamber 12. That is, the supporting member may be inserted into the microwave oven after removal of tray 5 and rotation guide 6. At least one supporting ring 24 is installed on the supporting member 21 for receiving and supporting the vessel 19. The supporting member 21 includes a pair of vertical members 21*a* for contacting both sides of the cooking chamber 12, and a horizontal member for connecting the vertical members 21 to each other and contacting the bottom of the cooking chamber 12. The supporting rings 24 are installed at respective inner sides of the pair of the vertical members 21*a*. The supporting rings 24 may be provided in pairs in the vertical direction, and are not limited to two pairs as shown in FIG. 4.

A plurality of hook apertures 23 are formed on the lower surface of the horizontal member 21*b* of the supporting member 21, and a plurality of hooks 12*b* corresponding to the hook apertures 23 are formed on the bottom surface 12*a* of the cooking chamber 12. Due to the construction of the hooks and hook apertures, the supporting member 21 can be detachably installed in the cooking chamber 12. Here, there can be another embodiment for a fixing means which includes the hook apertures 23 and hooks 12*b*. For example, the positions of the hook apertures 23 and the hooks 12*b* may be shifted relative to each other, or it is also possible to provide a rail between the supporting member 21 and both inner walls of the cooking chamber 12 so as to detachably install the supporting member 21 in the cooking chamber by sliding.

As shown in FIGS. 4 and 5, each supporting ring 24 is formed of two arc-shaped members 24*a*, and the two arc-shaped members are pivotally installed on the inner surface of the vertical member 21*a* by disposing hinge pins 25 so as to form a respective pair of two arc-shaped members. Springs 26 are disposed to the respective hinge pins 25 so that the arc-shaped members 24*a* are elastically biased in a direction wherein leading ends thereof face each other. By this construction, the vessel 19 is steadily supported.

Figure 6:
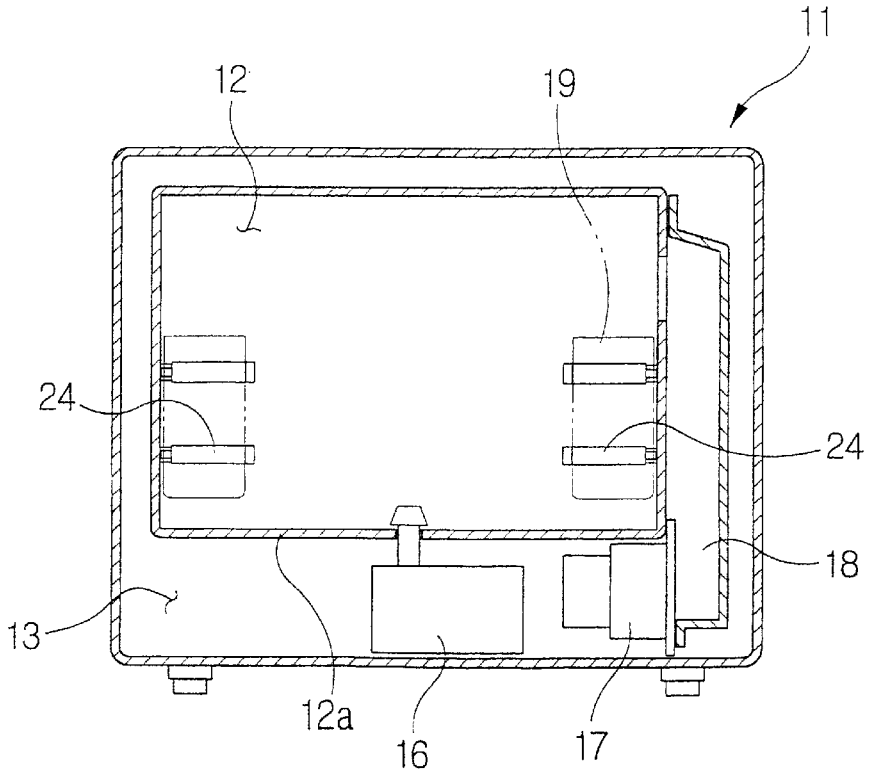
FIG. 6 is a sectional view showing a microwave oven according to another preferred embodiment of the present invention.
Figure 7:
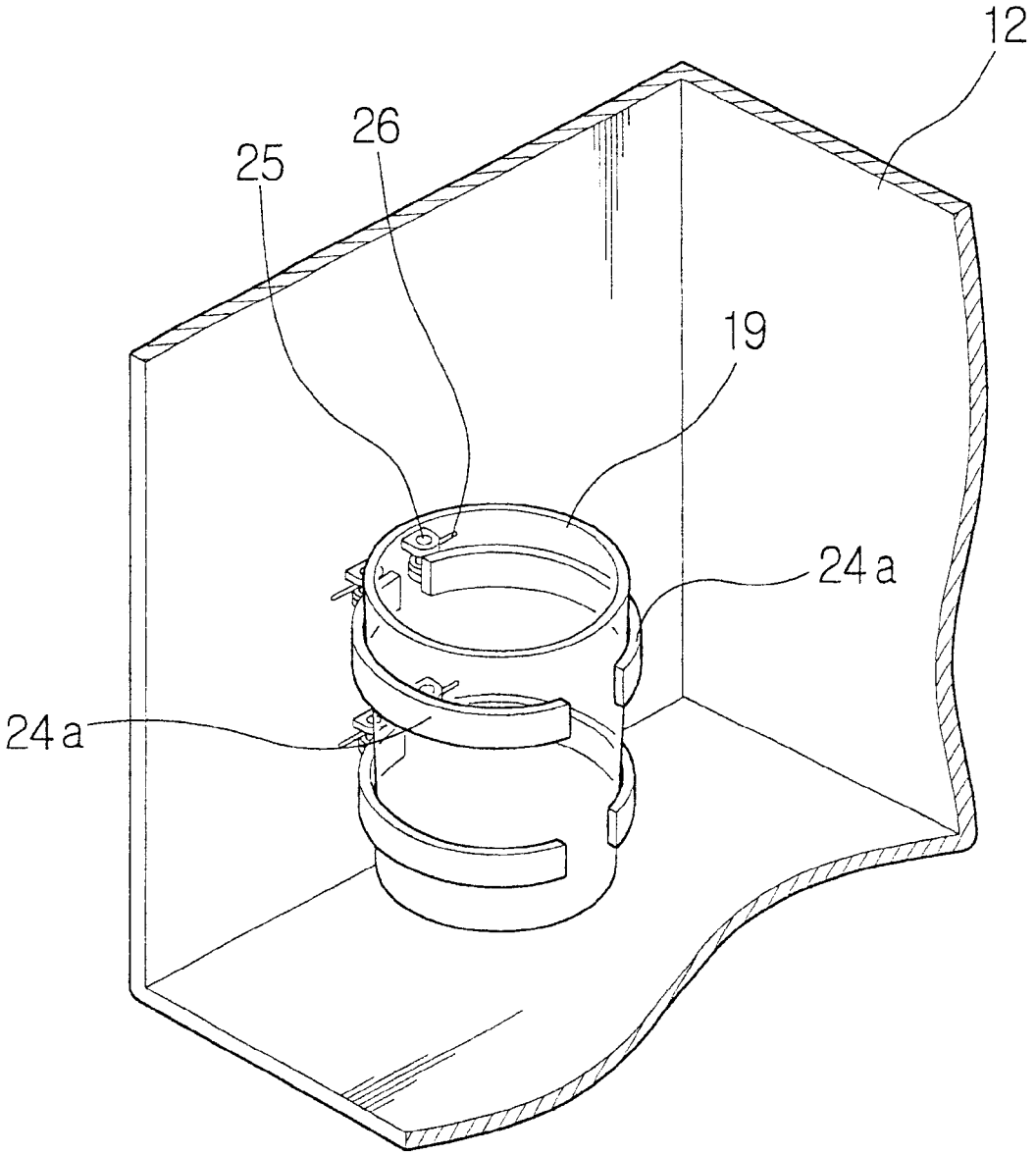
FIG. 7 is a perspective view showing a vessel supporting means as a main part of the microwave oven in FIG. 6.

FIGS. 6 and 7 show another embodiment of the vessel supporting section as a main part of the microwave oven of the present invention. As shown in FIGS. 6 and 7, the vessel supporting is section according to another embodiment of the present invention, includes at least one supporting ring 24 directly installed at one or both of the inner walls of the cooking chamber 12 for receiving the vessel 19 for containing food.

Since the construction and operation of the supporting rings 24 and other elements constructing the microwave oven are substantially identical to the previous preferred embodiment, the description of the supporting rings 24 and other elements are omitted by referring to the identical elements with the same reference numerals. According to the feature of the microwave oven according to this embodiment, unlike the previous embodiment, it is advantageous since the tray and/or the rotation guide (not shown) do not need to be removed in order to support the vessel by using the vessel supporting section.

In the microwave oven constructed above, like the conventional microwave oven, the cooking operation is performed with food placed on the tray. Then if a user wants to cook food in a vehicle in motion using a microwave oven loaded therein, the cooking operation is performed in with vessel 19 containing the food received and supported by the supporting rings 24 which are installed in the cooking chamber 12. As described above, since the vessel 19 containing the food is supported and prevented from swaying by the vessel supporting section, i.e., the supporting rings 24, the vessel 19 does not fall down due to the vibration and/or external shocks generated by the driving of the vehicle.

Therefore, with the microwave oven of the present invention, as described above, since the cooking operation is performed in the state that the vessel containing food is fixed and prevented from swaying by the vessel supporting section, the vessel containing food does not fall down even when vibration and/or the external shocks are applied to the vessel. Accordingly, a cooking operation may be conveniently performed even when the microwave oven is used in a vehicle in motion.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A microwave oven, comprising:

a cabinet;

a cooking chamber disposed inside said cabinet, said cooking chamber having a bottom, two sides, and a first coupling element formed on one of said bottom and said sides;

a high frequency generating means for generating high frequency electromagnetic radiation and supplying the high frequency electromagnetic radiation to said cooking chamber;

a supporting member removably inserted in said cooking chamber, having a second coupling element coupled to said first coupling element of said cooking chamber so that said supporting member is secured to said cooking chamber; and restraining means secured to said supporting member for restraining a vessel and preventing the vessel from tipping.

2. The microwave oven of claim 1, further comprising:

a removable tray, said tray being insertable into said cooking chamber when said supporting means is not inserted; and a tray driving section disposed below said cooking chamber, protruding from said bottom of said cooking chamber, being coupled to said tray for driving said tray.

3. The microwave oven of claim 1, said supporting member comprising:

a vertical member for contacting one side of said cooking chamber; and a horizontal member for contacting said bottom of said cooking chamber.

4. The microwave oven of claim 3, said supporting member further comprising:

a second vertical member for contacting the other side of said cooking chamber.

5. The microwave oven of claim 4, further comprising a second restraining means secured to said supporting member, said restraining means and said second restraining means both being attached respectively to said two sides of said cooking chamber.

6. The microwave oven of claim 3, said restraining means being attached to said vertical member of said supporting member.

7. A microwave oven, comprising:

a cabinet;

a cooking chamber inside said cabinet, said cooking chamber having a bottom and two sides;

a high frequency generating means for generating high frequency electromagnetic radiation and supplying the high frequency electromagnetic radiation to said cooking chamber;

a supporting member removably inserted in said cooking chamber, said supporting member comprising:

a first vertical member for contacting one side of said cooking chamber, said first vertical member having an inner surface; and a horizontal member for contacting said bottom of said cooking chamber; and a first supporting ring installed on said inner surface of said first vertical member, said first supporting ring including a pair of separate arc-shaped members each pivotally installed with a hinge pin on said inner surface of said first vertical member, each arc-shaped member having a leading end.

8. The microwave oven of claim 7, further comprising:

a spring disposed on each hinge pin for elastically biasing said arc-shaped members such that said leading ends face each other.

9. The microwave oven of claim 7, further comprising:

a second supporting ring installed on said inner surface of said first vertical member and vertically aligned with said first supporting ring.

10. The microwave oven of claim 9, said supporting member further comprising:

a second vertical member for contacting the opposite side of said cooking chamber from said first vertical member;

a third supporting ring installed on said inner surface of said second vertical member; and a fourth supporting ring installed on said inner surface of said second vertical member and vertically aligned with said third supporting ring.

11. The microwave oven of claim 7, further comprising:

said horizontal member having a hole; and a hook formed in the bottom of said cooking chamber for engaging said hole of said horizontal member.

12. The microwave oven of claim 7, further comprising:

said bottom of said cooking chamber having a hole; and a hook formed on the lower side of said horizontal member for engaging said hole.

13. The microwave oven of claim 7, further comprising:

a rail formed between said first vertical member and the side of said cooking chamber for sliding said supporting member into said cooking chamber.

14. The microwave oven of claim 7, further comprising:

said bottom of said cooking chamber having a guide groove for supporting a rotating guide for a tray.

15. A microwave oven, comprising:

a cabinet;

a cooking chamber inside said cabinet, said cooking chamber having a bottom and two side walls;

a high frequency generating means for generating high frequency electromagnetic radiation and supplying the high frequency electromagnetic radiation to said cooking chamber;

a first supporting ring installed on one of the side walls of the cooking chamber;

a pair of separate arc-shaped members each pivotally installed with a hinge pin on the one side wall, each arc-shaped member having a leading end; and a spring disposed on each hinge pin and having a first element coupled to said one side wall and a second element coupled to respective arc-shaped members for elastically biasing said arc-shaped members of said pair such that said leading ends face each other.

16. The microwave oven of claim 15, further comprising a second supporting ring installed on said one side wall of said cooking chamber and vertically aligned with said first supporting ring.

17. The microwave oven of claim 16, further comprising:

a third supporting ring installed on the second of said side walls of said cooking chamber; and a fourth supporting ring installed on said second of said side walls and vertically aligned with said third supporting ring.

* * * * *